United States Patent [19]

Russell et al.

[11] Patent Number: 4,624,615

[45] Date of Patent: Nov. 25, 1986

[54] STACKER FOR PANTS AND OTHER SEWN GARMENTS

[75] Inventors: Jackie D. Russell, Linn County; Kent M. Linneman, Chariton County, both of Mo.

[73] Assignee: The Biltwell Company, Inc., St. Louis, Mo.

[21] Appl. No.: 594,001

[22] Filed: Mar. 26, 1984 (Under 37 CFR 1.47)

[51] Int. Cl.[4] ..... D05B 33/00

[52] U.S. Cl. ..... 414/97; 112/121.29; 271/175; 414/29

[58] Field of Search ..... 83/83; 112/121.29; 271/175; 414/28, 29, 97

[56] References Cited

U.S. PATENT DOCUMENTS

| | | | |
|---|---|---|---|
| 3,371,631 | 3/1968 | Rockerath | 83/83 X |
| 3,788,248 | 1/1974 | Marforio | 112/121.29 |
| 4,067,272 | 1/1978 | Marforio | 112/121.29 |
| 4,307,675 | 12/1981 | Off et al. | 112/121.29 |

FOREIGN PATENT DOCUMENTS

| | | | |
|---|---|---|---|
| 234855 | 1/1969 | U.S.S.R. | 112/121.29 |

*Primary Examiner*—Robert J. Spar
*Assistant Examiner*—Janice Krizek
*Attorney, Agent, or Firm*—Donald J. Fitzpatrick

[57] ABSTRACT

A stacker for seizing and successively stacking sewn articles received from a sewing machine. A main support structure has a frame pivotally connected to it and extending upright, carrying a horizontal stacking bar for movement between an article receiving position extending laterally along the sewing table for receiving a sewn article from the sewing machine, and a retracted position spaced outwardly from the table. A clamping bar is carried parallel to the stacking bar by arm members pivotally connected to the frame for movement between an open position spaced from the stacking bar and a clamping position confronting it for gripping the sewn article therebetween. An air cylinder serves as a driving motor or prime mover for causing movement of the clamping bar to its clamping position, subsequent movement of the stacking bar to a retracted position by pivotal movement of the frame relative to the main support structure, and thereby seizing the received sewn article and pulling it from the sewing table and stacking it upon the stacking bar. Such cylinder then causes ultimate return movement of the stacking bar to its receiving position together with movement of the clamping bar to its open position in readiness for receiving another sewn article overlying the first.

2 Claims, 5 Drawing Figures

STACKER FOR PANTS AND OTHER SEWN GARMENTS

BACKGROUND AND SUMMARY OF THE INVENTION

This invention relates to sewing apparatus and garment or other sewn article handling apparatus useful for sewing apparatus, and more particularly, to a so-called garment stacker for seizing and stacking of sewn articles such as sewn panels forming work pieces of slacks, pants and shorts.

In garment manufacturing operations wherein sewing machines or the like are utilized for sewing together different pieces of fabric to provide a so-called panel which will become the leg of a pair of pants, slacks or shorts, it is desirable for the sewn article to be quickly removed from the machine after sewing and replaced by other articles to be sewn. For this purpose, there have been proposed various kinds of apparatus, as in Rockerath U.S. Pat. No. 3,371,631 and Korioth U.S. Pat. No. 3,246,616. In the latter, a stacker device engages the forward end of overlapped fabric portions to pull same rearwardly from the sewing machine, but without use of a stacking bar. In the former, a stacking bar merely swings from side to side arcuately to drape equal lengths of sewn material on opposite bar sides.

In a previous commercial type of pants stacker, a stacking bar was provided, being carried at opposite ends by arms pivoted from locations close to the sewing machine, an air cylinder being utilized for causing pivoting of the stacking bar rearwardly and downwardly from the sewing machine work surface. A further pair of arms carrying between their outer ends a clamping bar were pivoted to the first set of arms, and a second air cylinder was provided for providing mutual movement between the sets of arms. The pivoting geometry was such that the clamping bar was caused to swing up and toward the stacking bar for engaging same at some distance from the edge of the sewing machine table. In addition to objectionably utilizing two separate cylinders with inherent complexity and control interrelationship for providing the requisite movement not only of the stacking bar but also the clamping bar, this prior art arrangement also was disadvantageous in being unable to grip or clamp the edge of a sewn garment of short length, such as sewn panels for use in shorts or short length pants, such as children's sizes. Short work pieces, therefore, were required to be stacked by hand after each sewing operation was completed. The double cylinder arrangement in addition to being more expensive required duplicated maintenance efforts.

Accordingly, it is an object of the present invention to provide a garment stacker for use with a sewing apparatus, and specifically for location in immediate adjacency to a sewing machine table for seizing and stacking of sewn articles, such as panels for pants of both long and short length, including children's sizes, as well as shorts, and providing advantageous seizing of each sewn article, pulling it from the sewing table and stacking it on the stacking bar in succession to provide a multitude of neatly stacked articles readily presented thereby for use in further sewing operations, handling, packaging and the like.

It is another object of the invention to provide such a stacker which utilizes only a single driving means and thereby avoids duplicate, wasteful, uneconomic and maintenance-intensive duplication of prime movers or other driving members, thereby conducing to simplicity, low-cost, ease of maintenance and inherent reliability.

It is a further object of the invention to provide such a stacker which by its inherent geometry is appropriately configured for seizing of the sewn article in immediate adjacency to the sewing apparatus, being closely proximate to the edge of a sewing table whereby there is assured reliable receiving of the sewn article without resort to manual guiding or efforts on the part of the operator to introduce the edge of the sewn article into the stacker for being seized; and which, by its design, causes pulling of the sewn article rearwardly from the sewing apparatus in a direction imposing no undue strain upon the article and neither tending to dislodge previously stacked articles nor interfering with preparation by the operator for a subsequent sewing operation.

Still another object of the invention is the provision of such a stacker which provides inherent equalizing of the forces utilized for gripping and pulling of the sewn article during the stacking operation.

It is a further object of the invention to provide such a garment stacker which accumulates a relatively large number of stacked articles before requiring to be unloaded while preserving the stack of articles in a clean, unsoiled condition well-protected against exposure to mechanisms, lubricants, and from being contacted by persons or objects.

Briefly, a stacker as configured according to the present invention is utilized with a sewing apparatus such as a sewing machine having a sewing table. The stacker is utilized for seizing and stacking of the sewn articles in succession, and includes a stacking bar and a frame pivotally connected to the main support structure and carrying the stacking bar horizontally for movement between an article receiving position extending laterally along and closely proximate the edge of the sewing table for receiving the sewn article and a retracted position spaced outwardly from the sewing table edge. Also provided is a clamping bar, and means carrying the clamping bar parallel to the stacking bar and pivotally connected to such frame for movement of the clamping bar between an open position spaced from the stacking bar and a clamping position confronting the stacking bar for gripping of the received sewn article by pressure between the stacking and gripping bars. Driving means in the form of a single air cylinder is carried by the main support frame, being interconnected by a bell-crank with the frame and the clamping bar carrying means for causing movement of the clamping bar to its clamping position, subsequent movement of the stacking bar to its retracted position (thereby seizing the received sewn article, pulling it from the sewing apparatus, and stacking it on the stacking bar) as well as subsequent ultimate return movement of the stacking bar to its receiving position together with movement of the clamping bar to its open position. Accordingly, the stacking bar when again in its receiving position may receive another sewn article overlying the previously stacked article.

Other objects and features will be in part apparent and in part pointed out hereinbelow.

BRIEF DESCRIPTION OF THE DRAWINGS

Corresponding elements indicate corresponding parts throughout the several views of the drawings.

DESCRIPTION OF THE PREFERRED EMBODIMENT

Figure 1:
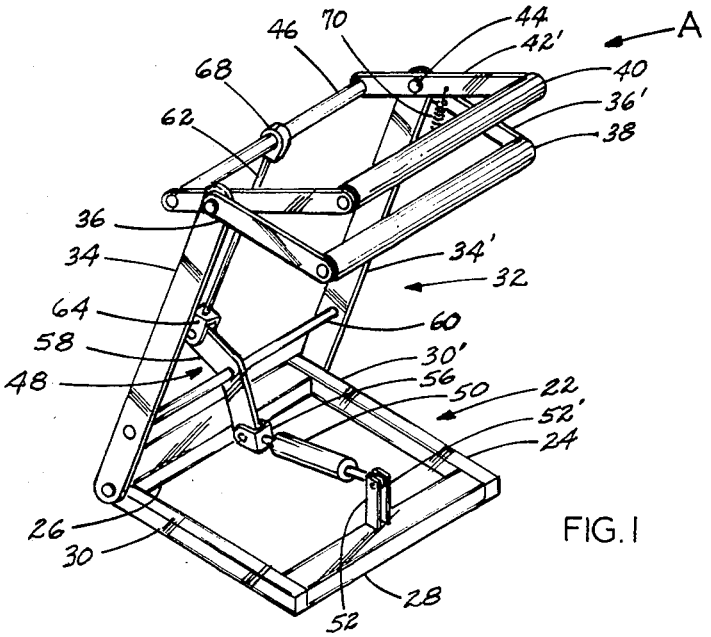
FIG. 1 is a perspective view of a stacker configured in accordance with and embodying the present invention.

Referring now to the drawings by reference characters, illustrated generally at reference character A is a new stacker in accordance with the invention, as utilized in conjunction with a sewing apparatus generally designated B. The latter may consist of a sewing table 10 upon which is located the usual sewing machine, such table being supported by legs or other structure as shown at 12 and including the usual operator control treadle 14 including conventional control means 16 operated by the treadle for controlling the speed of the sewing machine in ordinary operation.

Both sewing apparatus B and stacker A are located upon a factory floor 18 or other work surface, with apparatus A being positioned in immediate adjacency to sewing apparatus B as by being located immediately proximate the rear edge 20 of sewing table 10 for receiving sewn articles, such as panels for the assembly of trousers and shorts, as they are sewn and pushed rearwardly by the sewing machine (not shown) or the operator in usual fashion.

It will be understood that such articles, particularly in the case of panels for trousers and shorts, may be of various lengths and numbers of plies of material. Thus, in the case of boys' pants as well as shorts for men and boys, the panels will be of short overall length, whereas in the case of long mens' sizes, the panels may be of considerable length, all of which will be readily accommodated and reliably stacked by the new stacker A.

Referring to FIG. 1, stacker A comprises a main support structure 22 for being positioned and supported on the floor surface 18 rearwardly or otherwise closely adjacent to the sewing apparatus B for receiving the garments as sewn. Said structure 22 comprises a rectangular base framework 24 of welded steel construction or otherwise of strong, rigidly interconnected members including relatively substantial lateral frame members 26, 28 interconnected by side frame members 30, 30' for providing a stable base or frame of substantial dimensions for stably supporting apparatus A as well as a large stack of sewn articles as hereinbelow described. For utilization with conventional sewing machines and manufacturing operations, the overall dimensions of frame 24 may be approximately 2 ft.×2 ft. The members 26, 28 and 30, 30' may be of U-section stock or rectangular tubing, etc., all being preferably welded together.

Pivotally affixed to base frame 24 is another frame generally designated 32 comprised of barlike side frame members 34, 34' provided at their lower ends, as at 36 to the corresponding side frame members 30, 30' of frame 22. Members 34, 34' may be of steel. In the normal article-receiving orientation of stacker A shown in FIGS. 1 and 2, frame 32 forms, as will be apparent in FIG. 2, an acute angle $\alpha$ with frame 24. Rigidly affixed to the upper ends of members 30, 30' are corresponding forwardly extending frame members 36, 36' which carry at their outer, distal ends a so-called stacking bar 38 which may be of steel cylindrical stock or tubing welded or bolted at its opposite ends to frame members 36, 36'. Stacking bar 38 may be coated with rubber or other non-slip surface coating materials to prevent articles such as pants panels from slipping off the surface. Frame members 36, 36' may be welded at their proximate ends or bolted, etc., to the side frame members 34, 34' to provide an obtuse angle $\beta$ between them, and thereby providing, in the resting or article-receiving orientation of apparatus A shown in FIGS. 1 and 2, a parallel relationship between the side frame members 36, 36' and 30, 30', and providing, thereby, a horizontal relationship of frame members 36, 36', relative to floor surface 18, as well as aligned with or slightly below the sewing machine table 20.

Figure 2:
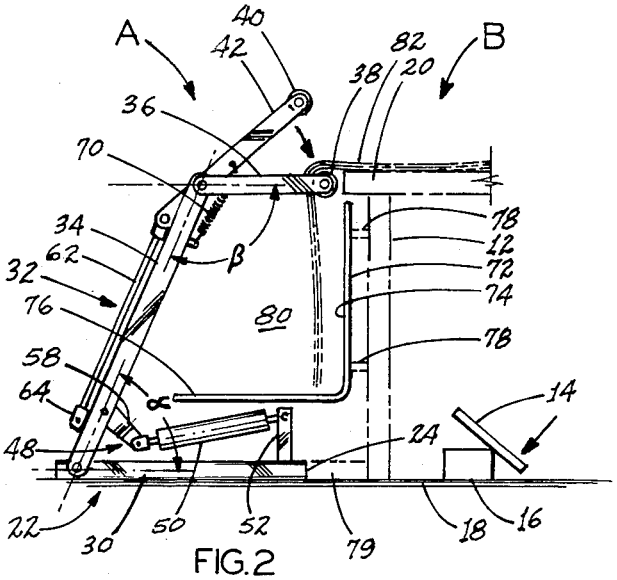
FIG. 2 is a side elevation view of the new stacker, as positioned in close adjacency to a sewing apparatus, and with the elements of the stacker being oriented for receiving a sewn article to be stacked.
Figure 3:
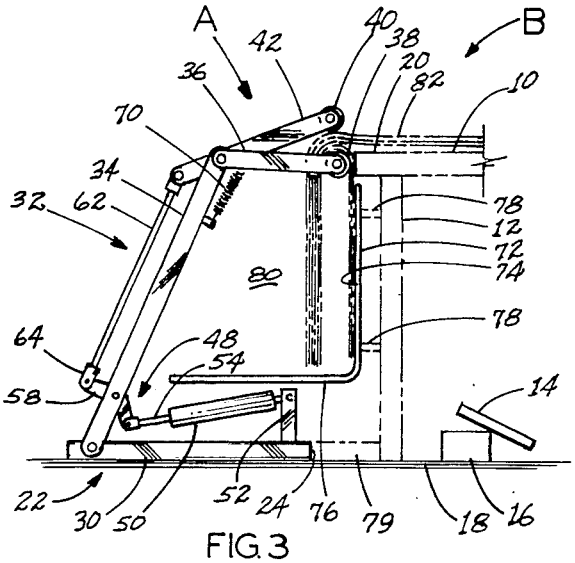
FIG. 3 is a similar side elevation view showing the elements of the stacker in a position clamping the sewn article for stacking same in an overlying relationship with a previously stacked article.
Figure 4:
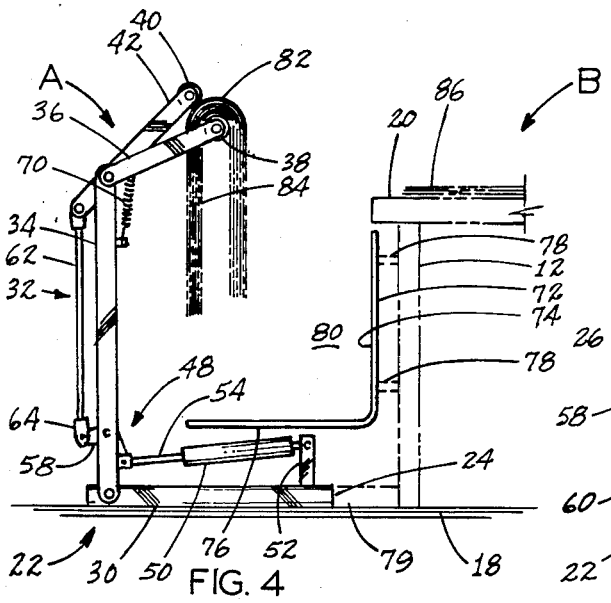
FIG. 4 is a similar side elevation view showing the elements of the stacker in a stacking position, and showing the stacking of multiple articles.
Figure 5:
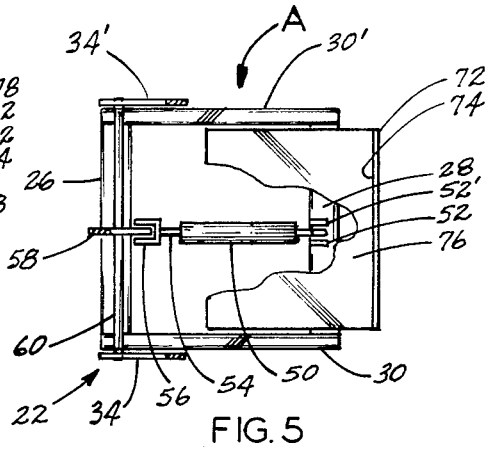
FIG. 5 is a top plan view, partly broken away and with elements of the stacker being sectioned.

In parallel relationship to stacking bar 38 is a clamping bar 40 of the same general configuration as bar 38, also rubber or non-slip coated if desired, and carried at the outer ends of a pair of arms 42, 42' which are pivoted, as indicated generally at 44 of frame members 34, 34' for pivotal movement relative to frame 32 between an open position (FIGS. 1 and 2) spaced from the stacking bar, and a clamping position (FIGS. 3 and 4). In the clamping position, clamping bar 40 confronts the stacking bar 30 and is urged against it for gripping a sewn article therebetween and, if a number of articles have already been stacked upon bar 38, all such articles. Arms 42, 42' extend rearwardly of the pivot point thus defined and have extending between their outer, remote ends a bar or shaft 46 with which a linkage generally designated 48 is interconnected.

Linkage 48 is operated by a single driving means in the form of an air cylinder 50 of extensible-retractible double acting character in which the usual piston is reciprocal in response to air pressure provided conventionally to opposite ends of clyinder 50. The linkage-remote end of clyinder 50 is pivotally connected between a pair of brackets 52, 52' which extend upwardly from the lateral frame member 28 of the main support structure 22, while the actuating rod 54 is pivotally connected, as at 56, to one end of a bell crank 58 pivotally carried upon a rod or shaft 60 which extends between the side frame members 34, 34'. A pushrod 62 is connected to the opposite end or point of connection of bell crank 58 by a yoke 64 and includes a fitting 68 connecting it to bar or shaft 46. Accordingly, it will be seen that elongation of cylinder 50, i.e., producing extension of its actuating rod 54, will cause rotation of bell crank 58 upon its shaft 60 with corresponding movement of pushrod 62 in a direction for causing clamping bar 40 to be brought into confrontation and urged against stacking bar 38, and articles thereon.

The dimensions of cylinder 50 and its actuating rod 54 are selected appropriately to define the angle $\alpha$ as well as the inclination of frame 32 when tipped rearwardly upon full extension of rod 54.

Also provided is a tension spring 70 which interconnects arm 42' with frame member 34', being maintained in a state of tension at all times and thereby urging clamping bar 40 in the direction of clamping movement toward stacking bar 38 when permitted by air cylinder 50. The purpose of spring 70 is to assist in and accelerate the clamping action, which, however, is brought about by operation of air cylinder 50.

The interconnection between control 16 and cylinder 50 is not illustrated, being well within the capability of the skilled user of pneumatic cylinders to interconnect in accordance with the purposes of the present invention.

It will be understood from the foregoing that air cylinder 50 constitutes a single driving means, carried by main support structure 22 and interconnected by means of linkage 48 with not only frame 32 but also the clamping bar carrying means formed by arms 42, 42', all for the purpose of providing a sequence of movements illustrated in FIGS. 2–5.

It will be observed from FIGS. 2–5 also that stacker A includes a guard or shield 72 which is in the form of a vertical panel 74 and a horizontal panel 76 which may together be formed of a single sheet of sheet metal suitably bent, and with the vertical panel 74 being secured as by brackets 78 to the sewing table leg 12 or other structure of sewing apparatus B. This orients the shield such that the horizontal panel 76 overlies the pneumatic cylinder 50 and other mechanical components of the new stacker while positioning the vertical panel 74 proximate sewing apparatus B for interposing a barrier between articles received upon stacking bar 38 and the various mechanisms of sewing apparatus B.

The orientation thus provided is such that the vertical panel 74 lies along and in front of a space generally designated 80 in which stacked articles may be received across stacker bar 38 whereas horizontal panel 76 extends beneath the stacked garments to provide a floor for said area 80 and shield the sewn article from contact with the mechanical components of the stacker. Thus, panels 74 and 76 ensure that regardless of length clothing articles and garment panels and the like received upon stacker bar 38 will be protected and shielded from contact with persons, mechanisms and other objects which may soil them during stacking.

To ensure that the stacker apparatus A remains fixed relative to the sewing apparatus B there may, if desired, be employed brackets, such as illustrated in phantom at 78, 79, for interengaging main support structure 22 and sewing table leg 12 or other structure thereof. Further, guard 72 may be directly secured either to said bracketry 79 or to the main support structure 22 rather than to the sewing table or its structure. Guard 72 may be formed of separate panels, if desired.

In operation, and referring first to FIG. 2, designated at 82 is a pants panel or overlying series of garment portions which have been received during the sewing operation by movement across sewing table 20. Because of the placement of stacker bar 38 proximate the rear edge of sewing table 20 in the article-receiving orientation of the new stacker, the sewn article passes over stacker bar 38 and hangs from the stacker bar, as shown in FIG. 1, parallel to guard 72. The sewing operation having been terminated, the operator tips backwardly upon the sewing machine control treadle 14, as illustrated by the directional symbol, causing control 16 to provide air to the linkage-remote end of cylinder 50 for producing elongation of its actuating rod 54. This drives bar or rod 46 in a direction for bringing clamping bar 40 into confrontation with stacking bar 38 as depicted by the directional symbol and with such movement being aided by spring 70. Suitable relays or interlock controls may be utilized for causing the following sequence of operation to continue without further effort on the part of the operator and permitting treadle 14 to be released as shown in FIG. 3.

Referring to FIG. 3, clamping bar 40 is shown in the position urged against the received sewn article 82 for gripping same between stacking and clamping bars 38, 40. In FIG. 3, an additional article or stack formed of previously stacked articles 84 is shown suspended from stacking bar 38 to demonstrate the relative orientation between article 82 and such previously stacked articles as would be obtained during the normal course of operation. It is seen in this view that the extension of actuator rod 54 of cylinder 50 has already commenced, producing the requisite closure of clamping bar 40 upon the article or articles upon stacking bar 38, but without movement frame 32 having yet taken place.

Referring then to FIG. 4, further elongation of cylinder 50 by extension of its actuating rod 54 produces rearward tipping of frame 32 while clamping bar 40 remains urged toward stacking bar 38. Rearward movement of the stacker bar 38 draws article 82 from the sewing table 20, stacking it atop the previous articles 84 neatly and in a reliable manner. The pulling of article 82 from the sewing table surface permits another article 86 to be sewn and moved rearwardly thereon by the operator. The management is self-equalizing since, regardless of the number of sewn articles carried by stacking bar 38, bell crank 58 causes clamping pressure to increasingly be applied by clamping bar 40 with the effect that, as additional force is delivered by cylinder 50 to tip back frame 32 with increasing weight of stacked articles, so also will additional clamping pressure be developed.

Rearward movement of frame 32 may be limited by appropriate selection of the dimensions of the elements of cylinder 50 and its actuating rod 54. Return movement may be effected by control 16 after a time delay or in response to the detection by a limit switch (not shown) associated with actuator rod 54 or frame 32 for causing air to be provided to the linkage side of cylinder 50 for retraction of its actuating rod 54 in a conventional manner, returning thereby frame 32 to its position shown in FIG. 2 and with continued retraction of actuator rod 54 causing the clamper bar 40 to be moved to its position spaced from stacking bar 38 for opening the space or jaws thus defined between bars 38 and 40. The apparatus is then configured once again as shown in FIG. 2 in readiness for receiving an article 86 over stacking bar 38 and overlying the articles previously stacked thereon, whereupon another cycle of operation is produced by the operator upon rearward movement of treadle 14 as above described.

A large number of articles, such as up to 30 or more in number, may be stacked in this manner conveniently and reliably before they need be removed or transferred to other operations.

The single pneumatic cylinder 50 provides but a single driving mechanism to assure of simplified maintenance and a paucity of separate elements and linkage components, thereby greatly adding to reliability and the general efficacy of the apparatus. Thus also, control 16 and the associated air delivery components are greatly simplified, contributing to making the entire apparatus more reliable than previously known.

The horizontal reach of arms 36, 36' toward the sewing table is optimum for seizing of all sizes of sewn articles and garments, including panels for pants with short trouser legs as well as shorts. The apparatus need not be reconfigured, therefore, for use in the sewing of such different items but instead readily accommodates all manner of sewn articles and sizes thereof. Further, the apparatus provides a uniform, reliable stacking operation, assuring that a large stack of garments will not become dislodged from stacking bar 38 or skewed during many successive stacking operations. The geometry of the new stacker is such that the rearward movement of a garment or article seized between the stacking bar 38 and clamping bar 40 is appropriate for preventing the articles from being dragged across the edge of the table and thereby avoids the frictional drag which is a potential cause for garments being dislodged from the stacking bar or skewed as they are successively stacked.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. For use with sewing apparatus or the like, a stacker for the seizing and stacking of sewn articles in succession comprising a main support structure, a stacking bar, a frame pivotally connected to the main support structure and carrying the stacking bar horizontally for movement between an article-receiving position extending laterally along and closely proximate the sewing apparatus for receiving a sewn article therefrom and a retracted position spaced outwardly from the sewing apparatus, a clamping bar, means carrying the clamping bar parallel to the stacking bar and pivotally connected to the frame for movement of the clamping bar between an open position spaced from the stacking bar and a clamping position confronting the stacking bar for gripping a sewn article therebetween, and a single driving means comprising an extensible-retractible cylinder having one end connected to the main support structure and a linkage comprising a bell crank carried by the frame and having a first point of connection to an actuating rod of the cylinder, and a pushrod connected to a second point of connection of the bell crank, the pushrod extending along the frame and interconnected with the clamping bar carrying means, said linkage interconnecting the other end of the cylinder with said frame and the clamping bar carrying means for causing (a) movement of the clamping bar to its clamping position, (b) subsequent movement of the stacking bar to its retracted position, thereby to seize the received sewn article, pull it from the sewing apparatus, and stack it on the stacking bar, and (c) ultimate return movement of the stacking bar to its receiving position together with movement of the clamping bar to its open position, whereby the stacking bar may receive another sewn article overlying the first article.

2. Apparatus as set forth in claim 1 wherein the clamping bar carrying means comprises a pair of arms pivotally affixed to the frame and having distal ends carrying the clamping bar therebetween and opposite ends commonly connected to a bell crank-remote end of the pushrod.

* * * * *